United States Patent [19]

Jones

[11] Patent Number: 4,767,290

[45] Date of Patent: Aug. 30, 1988

[54] FLUID PUMP

[76] Inventor: Ellis O. Jones, Oakley Crescent, Thames, New Zealand

[21] Appl. No.: 722,857

[22] Filed: Apr. 12, 1985

[51] Int. Cl.[4] ..... F04B 47/00

[52] U.S. Cl. ..... 417/490; 92/162 R; 92/83; 417/551

[58] Field of Search ..... 92/162, 162 R, 162 P, 92/83; 417/550, 551, 552–554, 490

[56] References Cited

U.S. PATENT DOCUMENTS

| | | | |
|---|---|---|---|
| 110,177 | 12/1870 | Ward | 92/162 R |
| 250,993 | 12/1881 | Sprague | 417/550 |
| 262,845 | 8/1882 | Sprague | 417/550 |
| 334,211 | 1/1886 | Babcox | 417/551 |
| 495,878 | 4/1893 | Clayton | 417/490 |
| 963,268 | 7/1910 | Becker | 417/490 X |
| 1,550,767 | 8/1925 | Weaver | 417/550 |
| 1,953,171 | 4/1934 | Griffiths | 92/162 |
| 1,956,868 | 5/1934 | Lemon | 92/162 |
| 2,357,434 | 9/1944 | Taylor | 92/162 R |
| 2,730,958 | 1/1956 | Nelson | 417/547 |
| 2,883,246 | 4/1959 | Hatch | 417/554 |
| 2,915,986 | 12/1959 | Sisson | 417/550 |
| 2,922,380 | 1/1960 | Pedlow, Jr. et al. | 417/550 |
| 3,044,403 | 7/1962 | Ronk | 417/554 |
| 3,148,629 | 9/1964 | Sutliff | 417/554 |
| 3,270,687 | 9/1966 | Hettinga | 417/547 |
| 3,684,410 | 8/1972 | Fitzgerald | 417/554 |
| 3,883,275 | 5/1975 | Browne | 417/DIG. 1 |
| 4,265,375 | 5/1981 | Flider | 417/554 |

FOREIGN PATENT DOCUMENTS

| | | | |
|---|---|---|---|
| 181528 | 6/1922 | United Kingdom | 92/83 |

*Primary Examiner*—Carlton R. Croyle
*Assistant Examiner*—Theodore Olds
*Attorney, Agent, or Firm*—Abelman Frayne Rezac & Schwab

[57] ABSTRACT

A self-priming pistonless lift pump has a first elongate tubular cylinder within which a second elongated tubular cylinder is loosely contained and freely slidable, the respective cylinders having inlet valves at their lower ends, and at their upper ends having fluid outlets, the outlet of the second tubular cylinder being transversely aligned with the outlet of the first cylinder when the second cylinder is in a lowermost position of travel within the first cylinder.

3 Claims, 3 Drawing Sheets

FLUID PUMP

Figure 1:
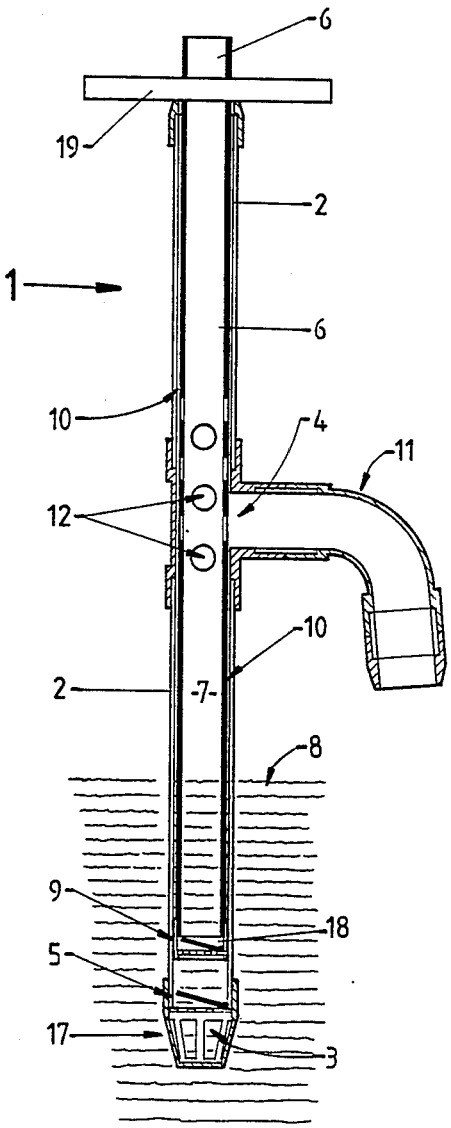

This invention relates to fluid pumps.

It is an object of the present invention to provide a fluid pump.

Further objects and advantages of the present invention will become apparent from the ensuing description which is given by way of example.

According to the present invention there is provided a fluid pump comprising an elongate tubular housing, an inlet at one end of the housing, an outlet at or near the other end of the housing, and a valving member positioned near the inlet to the housing, a plunger disposed within said housing and adapted to be reciprocated therein, said plunger having a passage therein for receiving and/or conveying a fluid and a valving member at or near its lower end, said plunger passage extending between the pump outlet and the valving member at the lower end thereof and being accommodated within the housing so as to provide at least one secondary passage communicable with the outlet between the outside of the plunger and the inside of the housing, the arrangement being such that on movement of the plunger in one direction the valving member at the inlet to the housing opens and the valving member at the lower end of said plunger closes with fluid being drawn into the housing towards the outlet, whilst movement of the plunger in an opposite direction causes the valving member at the inlet to close and the valving member at the lower end of the plunger to open offering a passage for fluids to pass to the outlet via the passage in the plunger and via said secondary passage.

The pumping action of a pump in accordance with one possible embodiment of the present invention is one which both lifts and drives a fluid up both the inside and outside of the plunger. The presence of the fluid between the outside of the plunger and the inside of the housing can provide an effective frictionless seal thereby obviating the need for sealing washers or the like, and providing a high degree of suction which comes into action on the upward stroke of the plunger.

With each upward stroke of the plunger the valving member for the plunger passage closes, and the fluid contained therein is raised in relation to the level of the fluid source a distance proportionate to the length of the stroke: at the same time, the upward stroke of the plunger creates suction in the housing which causes the valving member for the housing inlet to open and a quantity of fluid to occupy the vacuum in the housing left by the plunger.

On the downward stroke, the plunger valve opens and the housing valve closes such that more fluid enters the plunger passage and the fluid previously raised by upward strokes maintains its elevated position in relation to the level of the fluid source. Subsequent strokes of the plunger lift the fluid by steps towards the plunger passage outlet.

The reciprocating movement of the plunger also causes the fluid to travel up the secondary passage defined between the outside of the plunger and the inside of the housing. On the upward stroke, fluid in the secondary passage tends to be rolled upwards by the motion of the plunger, and on the downward stroke the plunger and fluid therein acts as a ram and drives fluid up the secondary passage towards the outlet. This is particularly so when the column of fluid in the plunger has been raised substantially above the level of the fluid source.

In another embodiment of the present invention described hereinafter, the pumping of fluid is less reliant on the secondary passage. In this embodiment a larger closer fitting plunger is used in the pump which reduces the size of the secondary passage but provides for a larger plunger passage capable of drawing greater volumes of fluid. The amount of fluid passing along the secondary passage is further restricted by a plurality of sleeves located around the plunger: these act as piston rings fitted loosely with respect to the inside of the housing. The presence of the sleeves may contribute to preventing fluid from reaching the pump outlet via the secondary passage, but they are not so obstructive nor is the arrangement of the plunger and the housing such that the pumping action (reciprocation of the plunger) is unable to maintain the presence of fluid in the secondary passage which provides sealing, lubrication and reduced drag between the plunger and housing.

A fluid pump in accordance with the present invention can be fabricated in a variety of materials which may include plastics (and in particular lightweight plastics such as PVC), fibreglass, or metal. Said fabrication materials need not be rigid but ought for most uses of the present invention be non-corrosible.

The housing and plunger can comprise lengths of tube section and a variety of shapes for same may be suitable. The plunger is dimensioned to fit inside the housing in a slidable fit and can have a shape which is complementary with the inside of the housing. It should however be appreciated that one of the characteristics of the present invention is that the pump is still functional even where a plunger is considerably undersize in relation to the housing: furthermore, the plunger need not have a shape which is commensurate with the housing in order to pump effectively and it may be that the differences in shape between the inside of the housing and the outside of the plunger are effective in providing larger or more defined secondary passages along which a fluid can pass.

The lengths of tube section which comprise the plunger and housing may be extensible by fixing thereto further lengths of tube section by way of inserts or additions.

An outlet may be provided in the side of the housing such that fluid which passes along the secondary passage is dispersed from the housing as it reaches the level of the outlet. A spout can be located around said outlet to conduct the fluid away from the pump.

An outlet means from the plunger passage may be provided which is approximately coincident with said outlet in the housing when the plunger is at rest in said housing, such that a fluid can escape from the plunger passage when it reaches said outlet means and is thereby dispersable from the pump via the outlet in the housing.

Where the fluid pump comprises a plunger which has its upper end part extending from said housing the outlet means in the plunger passage can comprise one or more apertures located in the walls of the plunger. Alternatively where the handle is mounted on a push rod which is connected to the plunger passage, an outlet means is provided through the open top of the plunger passage which may be approximately coincident with the outlet in the housing when the plunger is at rest in said housing, the arrangement being such that a fluid is dispersed from the top of the plunger passage and is thereafter free to exit the pump via the outlet in the housing.

In an alternative embodiment of the present invention, the plunger may comprise lengths of tube section of different diameters and thicknesses, and for instance that portion of the plunger in which the outlet to the plunger passage is located may comprise a length of tube section which is thicker and of lesser diameter than the remainder of the plunger body so that the plunger is not appreciably weakened by the presence of the outlet apertures.

In this embodiment a sleeve may be fixed to the outside of the top portion of the plunger body to provide strengthening to same. The said tube section of lesser diameter can be fixed inside the plunger body by means of adhesives and/or pins or screws which can be used to fix the inner tube section to the outer sleeve through the plunger body.

Where an outer sleeve is located just below the plunger passage outlet, and the plunger passage outlet is located in tube section which is narrower than the tube section from which the plunger body is fabricated, it will be found that a result of this arrangement is better venting of water from the plunger passage to the fluid outlet/spout in the housing.

In another embodiment of the present invention where the upper end part of the plunger extends a substantial distance from the housing, the outlet from the plunger passage may be the top of the plunger and thus the extended plunger passage acts as a conduit for fluid which is pumped from a fluid source.

The valving members comprise non-return valves which may be flap valves made of a variety of materials such as plastics, non-corrosible metals, rubber or the like. It will be appreciated that other types of non-return valves may be equally suitable and these may include ball valves or poppet valves.

Where the pump is required to pump liquids from substantial depths and considerable suction is required, the housing and plunger should be fabricated in a strong rigid material and the valving member likewise must be of a sturdy construction and firmly fixed to the housing and plunger.

A preferred form of valving member, especially for use in deep well pumps, may comprise a valve frame, a flap member, and a locating bar. The valve frame can be dimensioned to fit snugly inside the plunger and incorporates a plurality of apertures through which a fluid may pass. The flap member may comprise a piece of flexible impervious material which is dimensioned to cover said apertures and is held in position by means of the locating bar. The locating bar extends diametrically across the inner circumference of the plunger passage holding the flap in position at its middle section so that the two free sides of same are free to open and close against the valve frame.

The locating bar can be fixed to the valve frame and/or inside surface of the plunger so that it strengthens the valve frame and alleviates the problem of the valving member breaking or losing shape by the weight of fluid in the plunger passage.

The valving member can be further secured in position by means of a seat on which the valve frame rests and to which it is locatable in a snug complementary fit with respect to the inside of the plunger passage.

A sleeve may also be fixed to the outer surface of the plunger to strengthen the valve end of same. Said outer sleeve can be used to fix the locating bar and/or seat in place, and for instance these may be fixed together through the plunger body by means of pins, screws or the like.

The valving member for the fluid inlet to the housing may be located at the inlet end of the housing. Alternatively the said valving member may be located a distance from the fluid entry to the housing and thus the fluid is drawn up the housing and through the valving member by suction. A feature of this configuration is that the length of the plunger can be considerably less than that of the housing.

The inlet to the housing may comprise a plurality of apertures in the walls of the housing at the lower end of same, the arrangement being such that fluid is drawn in through the side of the housing rather than directly upwards into the housing thereby substantially overcoming the possible problems of extraneous matter being sucked into the pump where such matter exists on the floor of a fluid reservoir and blockage of the pump when the housing rests of the said reservoir floor.

In an alternatively embodiment the fluid inlet to the housing may be covered by a cap or cowl which incorporates a plurality of apertures in the sides thereof.

The plunger may be operated manually or by machine.

For manual operation the plunger where it extends from the housing can mount a handle or alternatively where it does not, the handle may be mounted on a push rod which is connected to the plunger. It should be appreciated that a variety of levers or handles for hand or foot actuation can be mounted with respect to the plunger and the pump is suitable for use with a rotary operating mechanism.

Figure 2:
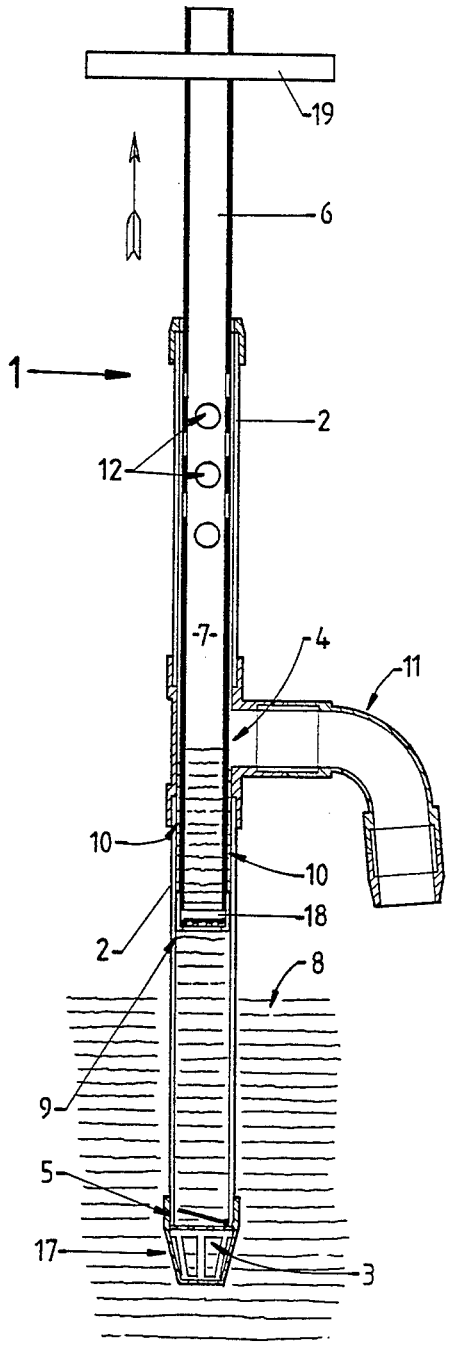
Figure 3:
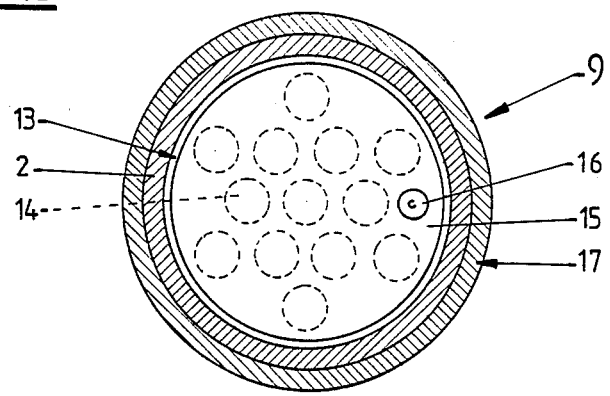
Figure 4:
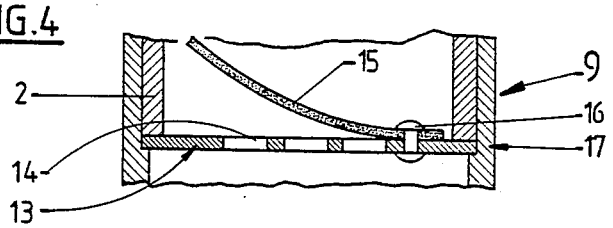
Figure 5:
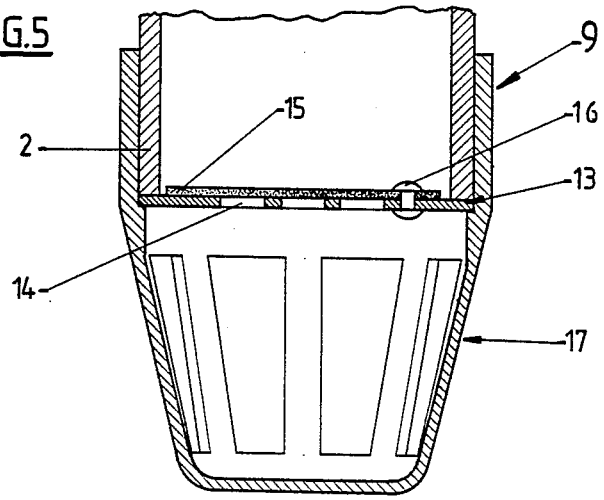
Figure 6:
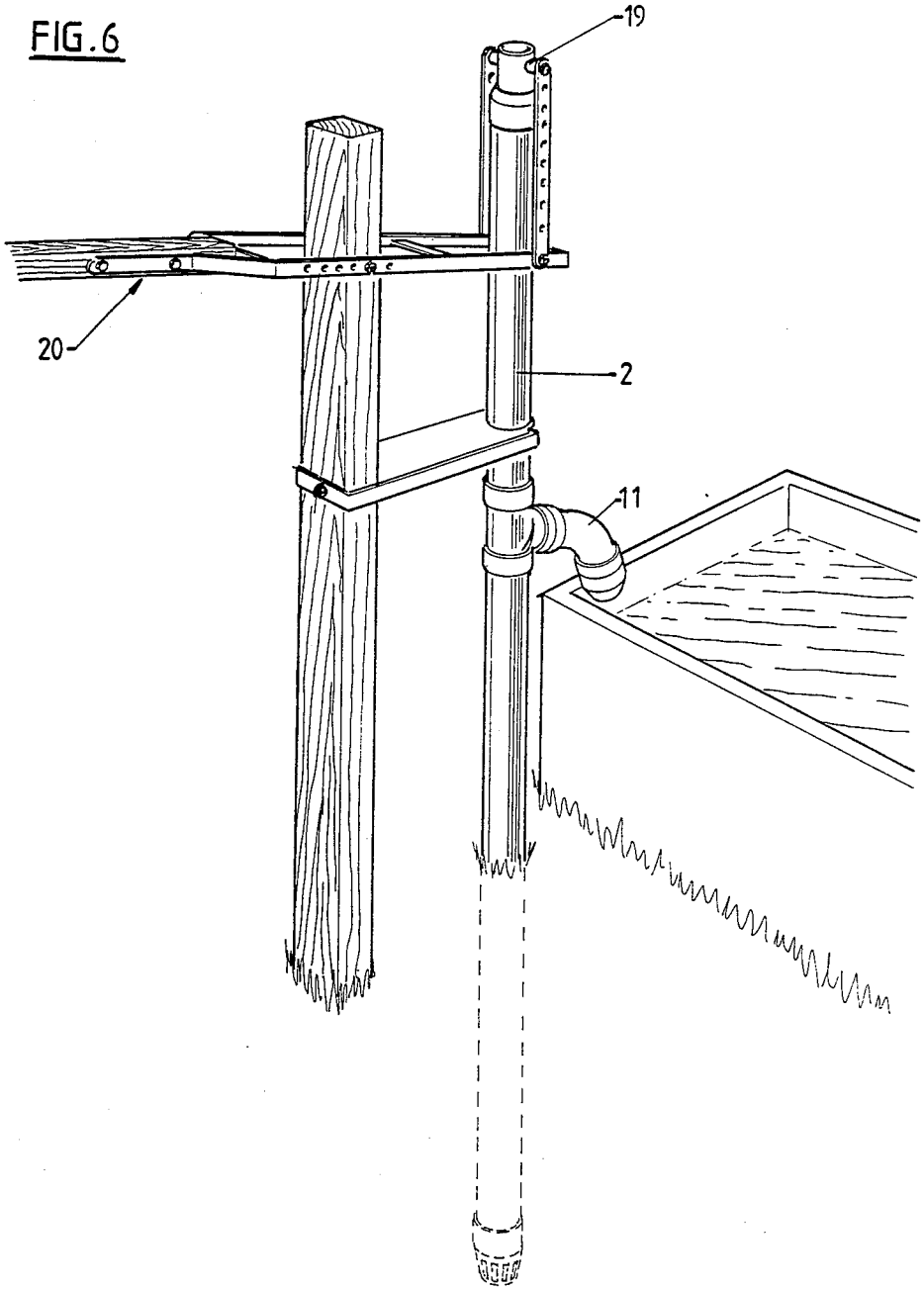

In order that the invention may be more readily understood, description now is directed to the accompanying drawings in which:

FIG. 1: is a cross-sectional view of a fluid pump in accordance with one preferred embodiment of the present invention, and FIG. 2: is a cross-sectional view of a fluid pump as shown in FIG. 1 when the plunger is completing an upward stroke, and FIG. 3: is a diagrammatic top view of a valving member for a fluid pump in accordance with one possible embodiment of the present invention, and FIG. 4: is across-sectional view of the valving member shown in FIG. 4, and FIG. 5: is a cross-sectional view of a fluid inlet and valving member for a housing in accordance with one possible embodiment of the present invention, and FIG. 6: is a perspective view of a fluid pump as shown in FIGS. 1 and 2 mounting a lever.

With reference to the drawings and the example illustrated a fluid pump generally indicated by arrow 1 comprises an elongate tubular housing 2, an inlet at one end of the housing generally indicated by arrow 3, an outlet at or near the other end of the housing generally indicated by arrow 4, and a valving member generally indicated by arrow 5 positioned near the inlet to the housing, a plunger 6 disposed within said housing 2 and adapted to be reciprocated therein, said plunger 6 having a passage 7 therein for receiving and/or conveying a fluid generally indicated by arrow 8 and a valving member generally indicated by arrow 9 at or near its lower end, said plunger passage 7 extending between the pump outlet 4 and the valving member 5 at the lower end thereof and being accommodated within the housing 2 so as to provide at least one secondary passage generally indicated by arrow 10 communicable with the outlet 4 between the outside of the plunger 6 and the inside of the housing 2, the arrangement being such that on movement of the plunger in one direction the valving member at the inlet 5 to the housing opens and the valving member 9 at the lower end of said plunger closes with fluid being drawn into the housing towards the outlet 4, whilst movement of the plunger in an opposite direction causes the valving member 5 at the inlet to close and the valving member 9 at the lower end of the plunger to open offering a passage for fluids to pass to the outlet 4 via the passage 7 int he plunger and via said secondary passage 10.

The housing 2 and plunger 6 are fabricated from lengths of circular tube section and the tube section of the plunger is undersized in relation to the housing such that a secondary passage 10 is defined between the outer surface of said plunger 6 and the inner surfaces of said housing 2.

The outlet 4 is a spout generally indicated by arrow 11 which is provided in the side of the housing from which fluid in a secondary passage is dispersed as it reaches the level of the outlet 4.

An outlet from the plunger generally indicated by arrow 12 comprises a plurality of apertures in the walls of the plunger 6 which are positioned approximately coincident with the outlet 4 when the plunger is at rest in the housing, the arrangement being such that on the downward stroke of the plunger more fluid is forced into the passage 7 from the housing 2 which causes the fluid rising adjacent the apertures 12 to escape from the plunger passage 7 into the outlet 4 either directly or via the secondary passage 10.

The valving members 5, 9 comprise non-return valves and in the embodiment shown in FIGS. 3, 4 and 5, the valving members comprise a frame generally indicated by arrow 13 through which a plurality of apertures 14 are provided and a flap 15 fixed to said frame by means of a pin 16.

A vented cowl generally indicated by arrow 17 is fixed over the housing inlet 3 to prevent the inlet from becoming blocked if the housing is rested on the floor of a fluid reservoir. The frame 13 of the inlet valve member 5 is interposed between the housing 2 and cowl 17 and is thereby held in place.

The frame for the flap valve 9 is seated in a holder 18 which is fixed to the end section of the plunger 6.

The upper end part of the plunger extends from the housing 2 and mounts a handle 19 which is a crosswise member which passes diametrically through the sides of the plunger.

A lever arrangement as shown in FIG. 6 can be connected to the crosswise member 19 so that less physical effort is required when manually operating the pump.

In operation, downward movement of the second cylinder will cause a first volume of fluid trapped in the lower end of the first cylinder to pass into the second cylinder and become trapped therein. Additionally, downward movement of the second cylinder will cause fluid to move upwardly in the annular space between the first and second cylinders.

Upward movement of the second cylinder will cause the fluid level in the first cylinder to be restored by the passage or inspiration of fluid into the lower end of the first cylinder through the valve controlled inlet opening of the first cylinder.

Subsequent downward movement of the second cylinder will cause a second volume of fluid trapped in the lower end of the first cylinder to pass into the second cylinder and become trapped therein, and also will cause fluid to move further upwardly in the annular space between the first and second cylinders in a stepwise manner.

Continued upward and downward movement of the second cylinder eventually results in the raising of the fluid level in the second cylinder to the level of the lateral opening in the second cylinder, at which point completion of priming of the pump is accomplished. Continued upward and downward movement of the second cylinder will then cause subsequent volumes of fluid passing into said second cylinder to flow out of the lateral opening in the second cylinder in the manner of an overflow and will raise the level of the water in the annular space to the level of the discharge outlet of the first cylinder.

As the second cylinder at this time is submerged within the water in the annular space surrounding the second cylinder, the only force, and an extremely minor force, required to effect pumping is that required to raise the water level within the second cylinder to above the level of the water in the annular space surrounding the second cylinder, the remaining column of the water within the second cylinder being supported within the column of water in the annular space surrounding the second cylinder. In this manner, only a minor amount of energy is expended in raising the column of water within the second cylinder on each pumping stroke of the second cylinder.

Aspects of the present invention have been described by way of example only and it will be appreciated that modifications and additions thereto may be made without departing from the spirit or scope thereof as defined in the appended claims.

I claim:

1. A self-priming pistonless lift pump, comprising:

a first tubular cylinder having an inlet opening at a lower end thereof and an outlet spaced therefrom and located at an upper end of said first cylinder;

a first valve associated with said lower end of said first tubular cylinder for limiting fluid flow into said first cylinder to a flow into said lower end of said first cylinder;

a second tubular cylinder loosely contained within said first tubular cylinder in co-axial relation therewith for sliding movement therein in the total absence of sealing contact between said first cylinder and said second cylinder and defining an annular space between said first and second cylinders;

said second cylinder having a lateral opening positioned in transverse alignment with the outlet opening of said first cylinder at the time said second cylinder is in a lowermost position of travel within said first cylinder;

a second valve associated with said second cylinder limiting the fluid flow into said second cylinder to flow into the lower end of said second cylinder; and means for axially reciprocating said second cylinder with said first cylinder between said lowermost position and an upward position, whereby, downward movement of said second cylinder will cause a first volume of fluid trapped in the lower end of said first cylinder to pass into said second cylinder and become trapped therein, and will also cause fluid to move upwardly in said annular space between said first and second cylinders;

upward movement of said second cylinder within said first cylinder will cause the fluid level in said first cylinder to be restored by passage of fluid into the lower end of said first cylinder through said valve controlled inlet opening of said first cylinder; and subsequent downward movement of said second cylinder will cause a second volume of fluid trapped within said first cylinder to pass into said second cylinder and become trapped therein, and also will cause fluid to move further upwardly in said annular space between said first and second cylinders in a step-wise manner;

continued upward and downward movement of said second cylinder within said first cylinder eventually resulting in the raising of the fluid level in said second cylinder to the level of the lateral opening in said second cylinder and completing priming of said pump;

subsequent downward movement of said second cylinder within said first cylinder then causing fluid within said second cylinder to flow out of the lateral opening of said second cylinder to raise the level of fluid in said annular space surrounding said second cylinder to the level of said outlet of said first cylinder, and then causing the volume of water exiting said second cylinder to exit the outlet of said first cylinder.

2. The pump of claim 1, in which at least said second cylinder is formed of a lightweight material in order to reduce the force required in lifting said second cylinder.

3. The pump of claim 1, further including a choke collar extending peripherally around the lower end of the said second cylinder and freely sideable within said first cylinder in spaced relation therewith, said choke collar reducing the extent of back flow of fluid contained within said annular space reversely into the lower end of said first cylinder, thus to maximize inspiration of fluid into the lower end of said first cylinder upon an upward movement of said second cylinder.

* * * * *